US006569307B2

(12) United States Patent
Blachier et al.

(10) Patent No.: US 6,569,307 B2
(45) Date of Patent: May 27, 2003

(54) OBJECT PLATING METHOD AND SYSTEM

(75) Inventors: Olivier J. Blachier, Santa Clara, CA (US); Frank Jansen, San Jose, CA (US); Colin John Dickinson, San Jose, CA (US); Peter M. Pozniak, San Jose, CA (US)

(73) Assignee: The BOC Group, Inc., Murray Hill, NJ (US)

( * ) Notice: Subject to any disclaimer, the term of this patent is extended or adjusted under 35 U.S.C. 154(b) by 0 days.

(21) Appl. No.: 09/742,135

(22) Filed: Dec. 22, 2000

(65) Prior Publication Data

US 2002/0112952 A1 Aug. 22, 2002

Related U.S. Application Data

(60) Provisional application No. 60/241,754, filed on Oct. 20, 2000, and provisional application No. 60/254,361, filed on Dec. 11, 2000.

(51) Int. Cl.[7] ..... C25D 21/12; C25D 21/18; B05D 1/18; C02F 1/42

(52) U.S. Cl. ..... 205/82; 205/83; 205/101; 205/148; 427/430.1; 210/660

(58) Field of Search ..... 205/101, 82, 83, 205/148; 427/430.1; 210/660

(56) References Cited

U.S. PATENT DOCUMENTS

| | | | | |
|---|---|---|---|---|
| 5,352,350 A | | 10/1994 | Andricacos et al. | 205/101 |
| 5,925,415 A | | 7/1999 | Fry et al. | 427/304 |
| 6,133,769 A | * | 9/2000 | Uzoh et al. | 205/101 |

* cited by examiner

*Primary Examiner*—Edna Wong
(74) *Attorney, Agent, or Firm*—Finnegan, Henderson, Farabow, Garrett & Dunner, L.L.P.

(57) ABSTRACT

A method and system are disclosed for plating objects. At least one aspect associated with the object plating is monitored to determine the amount of at least one byproduct created during the plating and/or the reduction in the amount of at least one plating component. Based on this monitored aspect, an adjustment is made to the flow rate of substances added to a plating cell and/or the flow rate of used plating substances drained from the plating cell. The used plating substances are purified to remove at least some of the byproduct and then the purified plating substances are combined with at least one component before passing back into the plating cell to reuse at least some of the plating substances. The method and system could be used during the plating of semiconductor wafers with copper.

45 Claims, 2 Drawing Sheets

OBJECT PLATING METHOD AND SYSTEM

This application claims benefit of U.S. Provisional Patent Application No. 60/241,754, filed Oct. 20, 2000, and U.S. Provisional Patent Application No. 60/254,361, filed Dec. 11, 2000.

BACKGROUND OF THE INVENTION

1. Field of the Invention

The present invention relates to a method and system for plating objects. More particularly, the present invention relates a plating method and system for substantially maintaining byproduct concentrations and/or plating component concentrations in a plating cell. An additional aspect of the invention relates to the reuse of at least some plating components and the monitoring of organic material in various substances.

2. Description of Related Art

Semiconductor chips are typically manufactured in a process involving the plating of metal components onto wafers. Due to a recent shift toward copper interconnect technology, plating techniques are being developed for plating wafers with copper material. Current copper plating processes, however, require costly consumable substances and generate a relatively significant amount of waste material that is costly to dispose and presents a number of environmental concerns.

In one conventional copper plating technique, wafers are plated in a cell filled with plating substances including both inorganic and organic additives. The inorganic additives include copper sulfate, sulfuric acid, water, and possibly hydrochloric acid.

Generally, the organic additives are categorized as either suppressors or accelerators, depending on their role in the electroplating process. As their names imply, suppressors act to impede the deposition of metallic copper on the cathodic surface, while accelerators enhance the deposition. Suppressors can be further characterized as either carriers or levelers. The suppressors are generally polymeric surfactants. In the case of carriers, they form a mono-layer at the cathode which offers a diffusion barrier to cupric ions, and enhances cathodic polarization needed for fine grain structure. Levelers are typically multiple-charged and adhere preferentially to highly charged areas such as corners and edges, and thus prevent overhanging at trench mouths. The large size of levelers impedes their migration into trenches, which in turn impedes conformal filling and allows for better bottom-up filling.

As mentioned above, organic additives also include accelerators. These substances are usually unsaturated compounds containing a polar sulfur, oxygen, or nitrogen functional group. They adsorb strongly and uniformly on seed surfaces, promoting dense nucleation and, consequently growth of fine grains. This leads to a uniformly smooth, well-textured (i.e. bright) finish. Accordingly, accelerators are often referred to as brighteners.

During a plating process, organic additives break down, with the accelerators generally tending to break down more rapidly than suppressors. In a simplified approach, it has been estimated that at least one commercially available plating chemistry has accelerator agents with a stoichiometric breakdown rate estimated at 2 mg/amp-hr while its suppressor agents break down at a rate of 10 mg/amp-hr.

Since organic materials break down during plating, a substantially continuous plating process requires some way of controlling levels of the organic additives in the plating cell. In addition, there is a need to control the levels of byproducts that are generated as a result of the breakdown of the organic additives.

The simplest approach to controlling levels of organic additives and their byproducts involves batch processing where a plating cell is initially filled with fresh plating substances and plating of wafers continues until the results become unacceptable. Then, the entire contents of the cell are drained and the cell is refilled again with fresh plating substances. This generates large quantities of waste, which must be treated because the waste contains relatively large amounts of copper and acid. Since this batch processing does not have direct control over the chemistry of the plating bath, a number of potentially reusable components from the drained cell are disposed without being reused.

Another approach to controlling organic additives and their byproducts is referred to as the "bleed and feed" approach. In bleeding and feeding, fresh plating substances are continuously added to the plating cell at a continuous flow rate while a portion of the contents are continuously drained from the cell at a constant flow rate and then disposed without being reused. Although this approach is slightly more sophisticated than the batch approach, both methods lead to substantially the same amount of waste generated over time. For example, the amount of waste could range from 10 cc/wafer to 25 cc/wafer at high wafer plating rates. In addition, while the bleed and feed approach does remove some of the contaminants associated with the break down of the organic additives, it does not completely remove them, and only dilutes them somewhat to a generally steady-state concentration. Over a period of time, the accumulation of the byproducts requires a complete draining of the plating cell and subsequent refilling.

In light of the foregoing, there is a need in the art for improving plating methods and systems.

SUMMARY OF THE INVENTION

Accordingly, the present invention is directed to a method and system that may substantially obviate one or more of the limitations of the related art. In particular, the present invention is directed to methods and systems that have particular advantages associated with the plating of copper onto wafers. The invention, in its broadest sense, however, could be used for plating of a wide variety of different substances onto a wide variety of different objects. For example, the present invention could be used for plating objects with gold.

In one aspect, the invention includes a method of plating objects. In one method according to the invention, plating substances are added to a plating cell. Objects are placed in the plating cell and plated in the plating cell. Plated objects are removed from the plating cell. Used plating substances, including at least one byproduct, are drained from the plating cell. At least one aspect associated with the plating of the objects is monitored. Based on the at least one monitored aspect, the flow rate of the plating substances added to the plating cell and/or the flow rate of the used plating substances drained from the plating cell are adjusted.

In one preferred practice of the method, at least one byproduct of at least one of the plating substances is created during the object plating, and the monitored aspect is related to the creation of the at least one byproduct. The flow rate adjustment(s) substantially maintain(s) a concentration of the at least one byproduct in the plating cell below a predetermined level.

In another preferred practice of the method, the amount of at least one component of the plating substances is reduced during the plating of the objects, and the monitored aspect is related to the reduction in amount of the at least one component of the plating substances during the plating. The flow rate adjustment(s) substantially maintain(s) a concentration of the at least one component in the plating cell above a predetermined level.

In yet another aspect of the method, the used plating substances are processed to convert at least part of the used plating substances into reusable plating substances. The reusable plating substances are added to the plating cell.

The monitored aspect is preferably chosen from the number of objects plated in the plating cell, the time elapsed during the plating of the objects, current density and/or electrical energy applied during the plating, idle time elapsed when the plating does not occur, the amount of agitation of substances in the plating cell, the amount of pulse plating occurring during the plating, temperature of substances in the plating cell, temperature of the plating cell, the deposition rate of material plated on the objects, the electrical conductivity of the material plated on the objects, the concentration of carbon in the material plated on the objects, the degree of void-free plating in trenches of the objects, and the chemical composition of the plating substances.

In another method according to the present invention, at least one byproduct of at least one of the plating substances is created during the plating of the objects. Used plating substances, including the at least one byproduct, are drained from the plating cell. The used plating substances are purified to remove at least some of the at least one byproduct and thereby create purified plating substances. At least one component is combined with the purified plating substances to create a mixture of plating substances. The mixture of plating substances is passed into the plating cell to thereby reuse the purified plating substances.

In one aspect, the at least one byproduct includes organic material, and the method further includes monitoring the level of organic material in the purified plating substances.

In another aspect, the level of organic material in the mixture of plating substances is monitored.

In addition, the method could further comprise adjusting, based on the monitored level of organic material, the amount of the at least one component combined with the purified plating substances.

In yet another aspect, the mixture of plating substances is passed into a storage tank, and the mixture in the storage tank is monitored to determine the level of organic material.

In still another aspect, multiple plating cells are provided and a separate storage tank is associated with each of the plating cells. The method further includes monitoring organic material in each storage tank substantially simultaneously. The organic material in each storage tank is preferably monitored via a separate sensing probe in each storage tank and a common controller receiving a respective signal from each sensing probe.

The purifying preferably includes at least one of filtering the used plating substances with activated carbon, filtering the used plating substances with at least one ion exchange medium compound, filtering the used plating substances with a particle removal filter, exposing the used plating substances to ultraviolet light, heating the used plating substances, exposing the used plating substances to at least one chemical oxidizing substance, and degassing the used plating substances. In the preferred embodiment, the purifying includes removing substantially all plating substances containing organic material, and the at least one component includes organic material.

In a further aspect of the invention, each object is a wafer configured to be a component of a semiconductor, and each wafer is plated with copper.

The invention also includes a system for use in plating objects. In one aspect, the system is configured to be used with a plating cell configured to plate objects. The plating cell is associated with means for adding plating substances to the plating cell, and means for draining used plating substances from the plating cell. The system includes at least one monitor configured to monitor at least one aspect associated with the plating of the objects. A controller is in electrical communication with the monitor. The controller is configured to control at least one of the adding means and the draining means, based on said at least one monitored aspect, to adjust at least one of the flow rate of the plating substances added to the plating cell, and the flow rate of the used plating substances drained from the plating cell.

In one aspect of the system, the used plating substances include at least one byproduct of at least one of the plating substances, and the byproduct is created during plating of the objects in the plating cell. The monitored aspect is related to the creation of the at least one byproduct, and the flow rate adjustment(s) provided by the controller substantially maintain(s) a concentration of the at least one byproduct in the plating cell below a predetermined level.

In another aspect of the system, the amount of at least one component of the plating substances is reduced during plating of objects in the plating cell. The monitored aspect is related to the reduction in amount of the at least one component of the plating substances during the plating, and the flow rate adjustment(s) provided by the controller substantially maintain(s) a concentration of the at least one component in the plating cell above a predetermined level.

The adding means and/or the draining means could include at least one of a pump and a flow control valve. The controller is preferably configured to control the pump(s) and/or flow control valve(s).

The system could further include a processing unit configured to convert at least part of the used plating substances into reusable plating substances, the reusable plating substances being reused in the plating cell.

The monitor is preferably configured to monitor at least one of the number of objects plated in the plating cell, the time elapsed during the plating of the objects, current density and/or electrical energy applied during the plating, idle time elapsed when the plating does not occur, the amount of agitation of substances in the plating cell, the amount of pulse plating occurring during the plating, temperature of substances in the plating cell, temperature of the plating cell, the deposition rate of material plated on the objects, the electrical conductivity of the material plated on the objects, the concentration of carbon in the material plated on the objects, the degree of void-free plating in trenches of the objects, and the chemical composition of the plating substances.

Another aspect of the invention involves a system including a purifier and a component combiner. The purifier is configured to purify the used plating substances to remove at least some of the at least one byproduct and thereby create purified plating substances. The component combiner is configured to combine at least one component with the purified plating substances to create a mixture of plating substances. The mixture of plating substances is passed into the plating cell to thereby reuse the purified plating substances.

In an additional aspect, the system includes a purified substance monitor configured to monitor the level of organic material in the purified plating substances.

Another aspect includes a mixture monitor configured to monitor the level of organic material in the mixture of plating substances.

Preferably, the system further comprises a controller in electrical communication with the monitor. The controller controls the component combiner, based on the monitored level of organic material, to adjust the amount of the at least one component combined with the purified plating substances.

In one other aspect, the system includes probes configured to be positioned in separate storage tanks so that organic material in separate tanks can be monitored separately, and a common controller receiving a respective signal from each sensing probe.

In an even further aspect, the purifier is configured to provide at least one of filtering the used plating substances with activated carbon, filtering the used plating substances with at least one ion exchange medium compound, filtering the used plating substances with a particle removal filter, exposing the used plating substances to ultraviolet light, heating the used plating substances, exposing the used plating substances to at least one chemical oxidizing substance, and degassing the used plating substances.

Another aspect relates to a structural arrangement and/or a plating method, wherein the following equation is satisfied:

$$C_{b,t2} = C_{b,t0} + \frac{(t2 - t1)}{V} \times (m_b - \eta_b \cdot dV_p \cdot C_{b,t1})$$

wherein $C_{b,\ t2}$=byproduct concentration at time t2, $C_{b,\ t1}$=byproduct concentration at time t1, $C_{b,\ t0}$=initial plating solution byproduct concentration, V=volume of plating substances in at least one of the plating cell and a storage tank associated with the plating cell, $m_b$=mass rate of byproduct build up, $dV_p$=liquid flow rate through the purifier, and $\eta_b$=byproduct removal efficiency of the purifier.

A further aspect relates to a structural arrangement and/or plating method, wherein the following equation is satisfied:

$$C_{c,t2} = C_{c,t0} + \frac{(t2 - t1)}{V} \times \left( \frac{V_c \cdot q \cdot dt}{(t2 - t1)} - m_c - h_c \cdot dV_p \cdot C_{c,t1} \right)$$

wherein $C_{c,\ t2}$=component concentration at time t2, $C_{c,\ t1}$=component concentration at time t1, $C_{c,\ t0}$=initial plating solution component concentration, $V_c$=flow rate of component introduction, q=component density, dt=time interval of component introduction, $m_c$=mass rate of component consumption during the plating, and $h_c$=component removal efficiency of the purifier.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate an embodiment of the invention and, together with the description, serve to explain the principles of the invention. In the drawings.

DESCRIPTION OF THE PREFERRED EMBODIMENT

Figure 1:
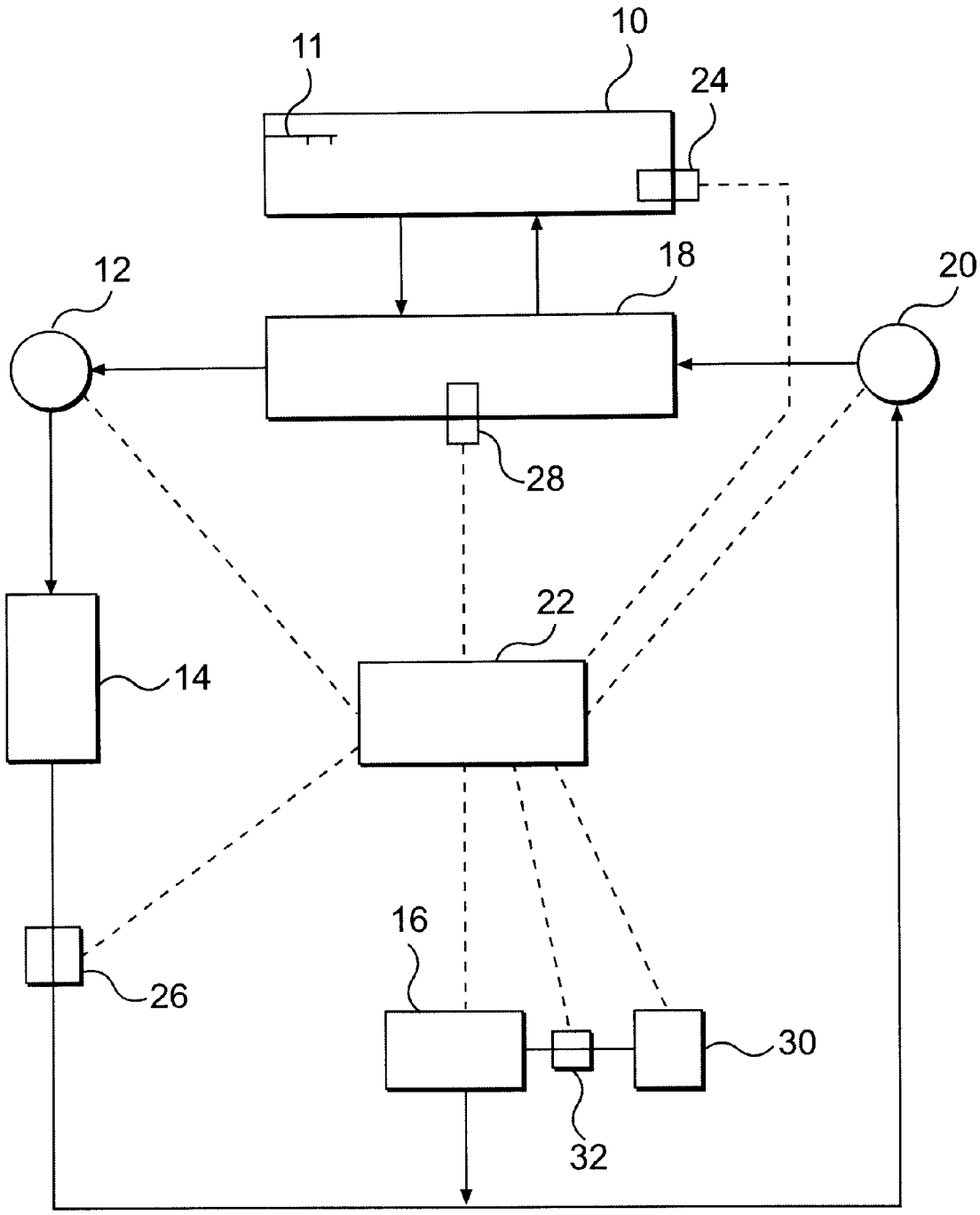
FIG. 1 is a schematic view of an object plating system in accordance with an embodiment of the invention wherein broken lines represent electrical interconnections and unbroken lines represent fluid couplings.

Reference will now be made in detail to the present preferred embodiment of the invention, an example of which is illustrated in the accompanying drawings. Wherever possible, the same reference numbers are used in the drawings and the description to refer to the same or like parts.

In accordance with the invention, there is provided an object plating system. As shown in FIG. 1, a preferred embodiment of the object plating system includes a plating cell 10, a draining unit 12, a purifier 14, a component combiner 16, a storage tank 18, and an adding unit 20. As explained in more detail below, this arrangement allows for recycling and reuse of substances during plating.

The plating cell 10 could be configured like any number of different conventional plating cells arranged to plate, onto objects, metal and/or other material initially present in plating substances contained in the plating cell 10. In the preferred practice of the present invention, the plating cell 10 is configured to plate copper onto wafers used for the fabrication of semiconductors. For example, the plating cell 10 could include an anode 11 and wafers placed into the plating cell 10 could act as cathodes. Preferably, the anode 11 is formed of high purity, solid copper containing no more than about 20 mg/l of sulfur, selenium, sodium, and phosphorous, either individually or in combination.

The plating cell 10 is preferably in direct flow communication with the storage tank 18 so that when the storage tank 18 is filled with plating substances (as it normally is during plating of objects in the cell 10), the addition of any further plating substances to the storage tank 18 causes flow of plating substances from the tank 18 to the cell 10 at substantially the same flow rate plating substances were added to the tank 18, and the removal of any plating substances from the tank 18 causes flow of plating substances from the cell 10 to the tank 18 at substantially the same flow rate plating substances were removed from the tank 18. The flow communication between the plating cell 10 and the storage tank 18 is also preferably configured so that the cell 10 and the tank 18 contain substantially the same concentrations of the plating substance components and byproducts of the plating substance.

The plating cell 10 and the storage tank 18 could contain plating substances including both organic and inorganic substances. During the plating in the plating cell 10, one or more byproducts of the plating substances are created and the amount of one or more components in the plating substances becomes reduced. The draining unit 12, which is preferably in direct flow communication with the storage tank 18, removes, from the storage tank 18 and plating cell 10, used plating substances including the byproducts. These used plating substances are then passed to the purifier 14, which is preferably configured to remove one or more of the byproducts from the used plating substances.

The purifier 14 could use any known technology for removing byproducts from the used plating substances. In the preferred embodiment, the purifier 14 is preferably configured to provide filtering of the used plating substances with activated carbon, filtering of the used plating substances with at least one ion exchange medium compound, filtering the used plating substances with a particle removal filter, exposure of the used plating substances to ultraviolet light (pulsed and/or unpulsed light), heating of the used plating substances, exposure of the used plating substances to at least one chemical oxidizing substance, and/or degassing of the used plating substances. When more than one byproduct removal method is utilized, the used plating substances could be sequentially treated by passing them through multiple, series-connected, treatment devices, each providing one or more of the byproduct removal methods, for example.

In one preferred practice of the invention, the purifier 14 is arranged to remove at least substantially all organic substances present in the used plating substances. In another preferred practice of the invention, the purifier 14 removes only select types of organic substances. The purifier 14 could also be configured to remove some select types of inorganic substances. For example, the purifier 14 could be configured to remove HCl.

The purifier 14 is associated with the component combiner 16 to provide a processing unit that converts the used plating substances into reusable plating substances capable of being used in the plating cell 10. When the purifier 14 has removed one or more byproducts, the resulting purified plating components pass to the component combiner 16, which is configured to add one or more components to the purified plating substance and thereby create a mixture of plating substances.

The component combiner 16 could be configured like any conventional structure used to combine constituent ingredients to form plating substances. For example, the component combiner 16 could be a device that is sometimes referred to as a "doser". In one preferred embodiment, the component combiner 16 is configured like the mixing apparatus described in application Ser. No. 09/512,752, filed Feb. 25, 2000, pending the disclosure of which is incorporated herein by reference. Preferably, the combiner 16 adds at least one or more organic materials to the purified plating substances passing from the purifier 14. In addition, the combiner 16 could be configured to add one or more types of inorganic substances, such as HCl, copper, $H_2SO_4$, and/or $H_2O$, for example.

When the combiner 16 has formulated the mixture of plating substances, the adding unit 20 preferably passes this mixture into the storage tank 18, which causes flow of plating substances from the storage tank 18 to the plating cell 10. During the continued plating of objects in the cell 10, the plating substance mixture added via the adding unit 20 is used for plating in the cell 10.

The preferred embodiment of the system preferably includes a controller 22 in electrical communication with the draining unit 12, the adding unit 20, and the component combiner 16. As schematically shown in FIG. 1, the controller 22 is also in electrical communication with a plating aspect monitor 24, a purified substance monitor 26, and a mixture monitor 28.

The plating aspect monitor 24 is preferably configured to monitor one or more aspects associated with the plating of objects in the plating cell 10. The monitored aspect is preferably related to the creation of at least one byproduct during plating and/or the reduction in amount of at least one component of the plating substances during the plating. For example, the plating aspect monitor 24 is preferably configured to monitor at least one of the number of objects plated in the plating cell, the time elapsed during the plating of the objects, current density and/or electrical energy applied during the plating, idle time elapsed when the plating does not occur, the amount of agitation of substances in the plating cell, the amount of pulse plating occurring during the plating, temperature of substances in the plating cell, temperature of the plating cell, the deposition rate of material plated on the objects, the electrical conductivity of the material plated on the objects, the concentration of carbon in the material plated on the objects, the degree of void-free plating in trenches of the objects, and the chemical composition of the plating substances. The monitoring of one or more of these aspects provides an indication of the condition of the plating substances in the plating cell 10.

Based on information provided by the plating aspect monitor 24, the controller 22 controls the adding unit 20 and/or the draining unit 12 to adjust at least one of the flow rate of the mixture of plating substances being added to the storage tank 18 and the plating cell 10 via the adding unit 20 and the flow rate of used plating substances being drained from the storage tank 18 and the plating cell 10 via the draining unit 12. Preferably, this controlling substantially maintains a concentration of at least one byproduct in the plating cell 10 below a predetermined level. The controlling also preferably acts to substantially maintain a concentration of at least one component (i.e., one or more organic components and, possibly, also one or more inorganic components) in the plating cell 10 above a predetermined level.

In the preferred embodiment, the adding unit 20 and the draining unit 12 include any type of conventional structure for providing variable rate fluid flow. For example, the adding unit 20 and draining unit 12 could each include a variable rate flow pump and/or a variable rate flow valve. Many other types of alternative arrangements are also possible.

Preferably, the controller 22 adjusts the adding unit 20 and/or the draining unit 12 such that the flow rate(s) prior to the adjustment and the flow rate(s) after the adjustment are different from one another and greater than zero. In other words, the flow rate adjustment preferably takes place while used plating substances continue to be removed via the draining unit 12 and while the mixture of plating substances continue to be added via the adding unit 20.

As mentioned above, the system also preferably includes a purified substance monitor 26 and a mixture monitor 28. The purified substance monitor 26 is preferably configured to monitor levels of materials that are intended to be removed by the purifier 14, and the mixture monitor 28 is preferably configured to monitor levels of materials that are intended to be added via the component combiner 16. Based on data provided by the monitors 26 and 28, the controller 22 preferably controls the component combiner 16 to adjust the amount of one or more components being added by the combiner 16.

For example, when the purifier 14 is configured to remove at least one organic substance and the component combiner 16 is configured to combine at least one organic component to formulate a mixture, the monitors 26 and 28 are preferably configured to monitor the amount of organic material in the purified substance and the plating substance mixture, respectively.

In the preferred embodiment, the mixture monitor 28 is a probe configured to measure the concentration of both organic material and inorganic material, the probe being configured to be positioned in storage tank 18. For example, the mixture monitor 28 could be a conventional monitor sometimes referred to as an RTA probe, which is configured to be positioned in the storage tank 18. In a preferred embodiment of the invention shown in FIG. 2, a plurality of monitors 28*a*, 28*b*, and 28*c*, like the monitor 28 of FIG. 1, could each be positioned in a respective storage tank 18*a*, 18*b*, 18*c* each associated with a separate respective plating cell (not shown). Each of the monitors 28*a*, 28*b*, and 28*c* could provide data to the controller 22 so that the organic material (and, optionally, also the inorganic material) in the storage tanks 18*a*, 18*b*, 18*c* can be monitored simultaneously.

Alternative arrangements are, of course, possible. For example, the system could have a single purifier arranged to remove at least one byproduct from used plating substances removed from a plurality of different plating cells. In addition, the combiner could be configured to formulate plating mixtures used in a plurality of different plating cells.

As shown in FIG. 1, the plating system also preferably includes a supplier 30 configured to supply fresh, virgin plating substances to the plating cell 10, via the component combiner 16, adding unit 20, and storage tank 18, when the plating cell 10 is in need of filling at the beginning of a plating procedure and, optionally, also during a plating procedure. Before passing from the component combiner 16, the fresh plating substances flowing from the supplier 30 preferably pass through an ion removing unit 32 configured to remove one or more predetermined types of free ions from the fresh plating substances. When the system is used for copper plating, the ion removing unit 32 is preferably configured to remove free sodium and sulfur ions, and more preferably configured to remove any free ions except for carbon, oxygen, and hydrogen ions. The supplier 30 and/or the ion removing unit 32 could be controlled by the controller 22, for example.

Figure 2:
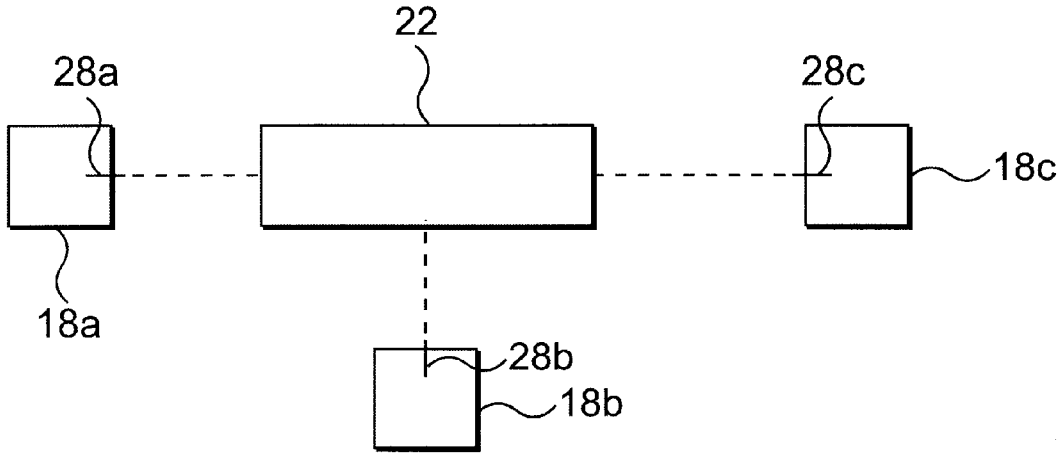
FIG. 2 is a schematic view of a controller shown in FIG. 1 associated with a plurality of probes monitoring conditions in separate storage tanks.

Preferred methods for plating wafers with copper are discussed below with reference to FIGS. 1 and 2. Although the invention is described in connection with copper plating of wafers, it should be understood that the invention in its broadest sense is not so limited. Certain aspects of the invention may be used for plating many different types of objects with many different types of materials, regardless of whether they are related to the field of semiconductors and/or copper plating. In addition, aspects of the method could be practiced with structure different from that shown in FIGS. 1 and 2.

Initially, the supplier 30 adds fresh plating substances to the plating cell 10 via the ion removing unit 32, component combiner 16, adding unit 20, and storage tank 18. The ion removing unit 32 preferably removes one or more types of free ions, such as free ions of sodium and sulfur, from the plating substances. Preferably, the plating substances include organic and inorganic substances typically used for plating of wafers with copper.

Unplated wafers are placed in the plating cell 10 and copper is plated on the wafers in any known manner. As the plating process continues, copper plated wafers are removed from the plating cell 10 and additional unplated wafers are added to the cell 10. The copper plating causes at least some of the organic components of the plating substances to create byproducts, such as short-chain polyethylene glycols. The copper plating also causes a depletion in the amount of certain components in the plating substances, such as HCl and/or accelerators.

An amount of used plating substances is drained from the plating cell 10 via the storage tank 18 and the draining unit 12, preferably in a continuous manner, substantially throughout the entire plating process. The purifier 14 preferably purifies the used plating substances by removing at least some or substantially all of the organic materials, including the byproducts generated during plating. For example, the purifier 14 could remove short-chain polyethylene glycols. In addition, the purifier 14 could also remove some inorganic materials, such as HCl, for example.

The purified substance monitor 26 monitors the level of organic materials contained in the purified substances and the information from the monitor 26 is communicated to the controller 22. Based on the information from the purified substance monitor 22, the controller 22 controls the component combiner 16 to combine an amount of one or more components to the purified substance and thereby create a mixture of plating substances. For example, the component combiner 16 could add components such as HCl and/or accelerators.

The adding unit 20 passes the resulting mixture of plating substances into the storage tank 18, where the mixture monitor 28 monitors the amount of organic material in the mixture. This mixture passes into the plating cell 10 to thereby reuse at least some of the substances that were originally present in the cell 10. Preferably, the adding unit 20 operates to add the mixture of plating substances to the storage tank 18 and the plating cell 10 in a continuous manner throughout substantially the entire plating process. Optionally, if desired during the plating process, the supplier 30 could also add to the plating cell 10 (via the combiner 16, adding unit 20, and tank 18) an amount of fresh, virgin plating substances that have not been recycled.

The controller 22 obtains information from the mixture monitor 28 and preferably uses this information to control the component combiner 16. For example, if the mixture monitor 28 detects a relatively high (or low) level of organic material, the controller 22 could adjust the component combiner 16 to add less (or more) components containing organic material. In addition, if the purified substance monitor 26 detects a relatively high level of organic material that is being removed by the purifier 14, the controller 22 could adjust the component combiner 16 to add less components containing organic material. The controller 22 could also control the supplier 30.

While wafers are being plated in the plating cell 10, the plating aspect monitor 24 monitors one or more aspects associated with the plating. As mentioned above, the monitored aspect is related to the creation of at least one byproduct in the plating cell 10 and/or the reduction in amount of one or more components of the plating substances in the plating cell 10. Based on the aspect(s) monitored by the monitor 24, the controller 22 preferably controls the draining unit 12 to adjust the flow rate of used plating substances being removed from the storage tank 18 and the plating cell 10 and/or controls the adding unit 20 to adjust the flow rate of plating substance mixture being added to the storage tank 18 and the plating cell 10. The flow rate adjustment preferably maintains a concentration of one or more byproducts in the plating cell 10 below a predetermined amount and/or maintains a concentration of at least one component in the plating cell 10 above a predetermined amount.

For example, when the aspect monitor 24 detects an aspect related to the increased amount of a byproduct capable of being removed by the purifier 14, the controller 22 could control the draining unit 12 to increase the flow rate of used plating substances being removed from the storage tank 18 and the plating cell 10, and/or control the adding unit 20 to increase the flow rate of plating substance mixture being added to the storage tank 18 and the plating cell 10. Such flow rate adjustment could decrease the concentration of the byproduct in the plating cell 10 in a relatively automatic and rapid manner.

To provide a further example, when the aspect monitor 24 detects an aspect related to the decrease of a component being added by the component combiner 16, the controller 22 could control the draining unit 12 to increase the flow rate of used plating substances being removed from the storage tank 18 and the plating cell 10, and/or control the adding unit 20 to increase the flow rate of plating substance mixture being added to the storage tank and the plating cell 10. Such flow rate adjustment could increase the amount of the component in the plating cell 10 in a relatively automatic and rapid manner.

The controller 22 could control the draining unit 12 and adding unit 20 to each provide flow rates ranging from about 5 ml/min to about 25 ml/min, for example.

In addition to controlling the draining unit 12 and adding unit 20 based on the information from the aspect monitor 24, the controller 22 could also control the combiner 16, based on this information, to add more or less or a particular component related to the aspect being monitored.

Other ways of practicing various aspects of the method are also possible. For example, the flow rate adjustment of the draining unit 12 and/or adding unit 20 could also be used in a plating process that does not involve a purifier 14 and/or component combiner 16.

In one example of a preferred practice of the present invention, where copper material is plated on wafers in the plating cell 10, the system and method maintain concentrations such that, the plating cell's plating substances include copper ($Cu^{++}$) at a concentration of about 17 g/l, $H_2SO_4$ at a concentration of about 200 g/l, chloride ($Cl^-$) at a concentration of about 30 mg/l, one or more suppressors at a concentration of about 18 ml/l, and/or one or more accelerators at a concentration of about 1 ml/l, for example.

The controller 22 could be configured in many different ways to maintain the concentration of one or more byproducts in the plating cell 10 below a predetermined level and/or maintain the concentration of one or more plating substance components above a predetermined level. For example, the controller 22 could be configured to maintain byproduct concentration such that the following equation is satisfied:

$$C_{b,t2} = C_{b,t0} + \frac{(t2 - t1)}{V} \times (m_b - \eta_b \cdot dV_p \cdot C_{b,t1})$$

wherein $C_{b,\,t2}$=byproduct concentration at time t2, in mg per liter, for example;

$C_{b,\,t1}$=byproduct concentration at time t1, in mg per liter, for example;

$C_{b,\,t0}$=initial plating solution byproduct concentration, in mg per liter, for example;

V=volume of plating substances in the storage tank 18 and/or plating cell 10, in liters, for example;

$m_b$=mass rate of byproduct build up, in mg per minute, for example;

$dV_p$=liquid flow rate through the purifier 14, in liters per minute, for example (i.e., the flow rate provided by draining unit 12); and $\eta_b$=byproduct removal efficiency of the purifier 14.

For example, the controller 22 could also be configured to maintain component concentration such that the following equation is satisfied:

$$C_{c,t2} = C_{c,t0} + \frac{(t2 - t1)}{V} \times \left( \frac{V_c \cdot q \cdot dt}{(t2 - t1)} - m_c - h_c \cdot dV_p \cdot C_{c,t1} \right)$$

wherein $C_{c,\,t2}$=component concentration at time t2, in mg per liter, for example;

$C_{c,\,t1}$=component concentration at time t1, mg per liter, for example;

$C_{c,\,t0}$=initial plating solution component concentration, in mg per liter, for example;

$V_c$=flow rate of component introduction, in liters per minute, for example (from combiner 16);

q=component density, in mg per liter, for example;

dt=time interval of component dosing by the combiner 16, for continuous flow, dt=t2−t1;

$m_c$=mass rate of component consumption during the plating process, in mg per minute, for example; and $h_c$=component removal efficiency of the purifier 14.

The controller 22 preferably determines byproduct concentrations $C_b$ and component concentrations $C_c$ based on input from the plating aspect monitor 24 and/or the mixture monitor 28. The controller 22 preferably determines the volume V based on input from one or more level detectors (not shown), such as ultrasonic level detectors.

After determining byproduct and component concentrations, the controller 22 preferably determines the purifier flow rate, component introduction flow rate, and time interval for component dosing to establish target concentrations for byproducts and components. The mass rate of byproduct buildup, $m_b$, and mass rate of component consumption, $m_c$, are preferably calculated by temporarily setting the purifier flow rate and component introduction flow rate to zero and then monitoring the rate of rise (or fall) in concentrations.

This will determine $m_c$. The value for $m_b$ will be assumed to be equivalent to $m_c$ in a first approximation. (In practice, $m_b<m_c$ because of the drag-in process of organic additives into the deposited film). Then, a maximum allowable byproduct value ($C_{b,\,t}$) and $dV_p$ are preferably calculated.

The above equations are preferably used such that the concentration output at time t2 will be used in the next iteration as the concentration at t1 to allow sequential use of the equations and software control.

The above-mentioned equations allow mass rate of byproduct build up to be calculated without additional input variables and organic purifier feed rate to be dynamically adjusted to provide faster control to the set point concentration. This could enable lower plating bath volumes to be used successfully so that much faster response can be implemented with the confidence of satisfactory contamination control.

The system and method according to the invention could provide several advantages over previous modes of plating bath management. For example, by selectively stripping at least some amount of the organic components and then replacing them, cleaner and more repeatable bath chemistry can be maintained. By establishing a closed loop for solution regeneration, costly treatment of waste copper and acid can preferably be eliminated. Finally, the continuous purification of the regenerated chemistry can ultimately result in an optimized process control for the plating tool manufacturer and the end user. Of course, many aspects of the invention could be practiced without necessarily accomplishing one or more of these advantages.

It will be apparent to those skilled in the art that various modifications and variations can be made to the structure and methodology of the present invention without departing from the scope or spirit of the invention. In view of the foregoing, it is intended that the present invention cover modifications and variations of this invention provided they fall within the scope of the following claims and their equivalents.

What is claimed is:

1. A method of plating objects, the method comprising:

adding plating substances to a plating cell;

placing objects in the plating cell;

plating the objects in the plating cell, wherein at least one byproduct of at least one of the plating substances is created during the plating;

removing the plated objects from the plating cell;

draining used plating substances from the plating cell, the used plating substances including the at least one byproduct;

monitoring at least one aspect associated with the plating of the objects, the aspect being related to the creation of the at least one byproduct; and adjusting, based on said at least one monitored aspect, at least one of the flow rate of the plating substances added to the plating cell from at least one rate greater than zero to another rate greater than zero, and the flow rate of the used plating substances drained from the plating cell from at least one rate greater than zero to another rate greater than zero, to substantially maintain a concentration of the at least one byproduct in the plating cell below a predetermined level.

2. The method of claim 1, wherein the adjusting includes both adjusting the flow rate of the plating substances added to the plating cell and adjusting the flow rate of the used plating substances drained from the plating cell.

3. The method of claim 1, wherein the plating substances include organic substances and inorganic substances, and wherein said at least one byproduct is created from at least one of the organic substances.

4. The method of claim 1, wherein both the adding of the plating substances and the draining of the used plating substances occur during substantially all of the plating of the objects.

5. The method of claim 1, further comprising processing the used plating substances to convert at least part of the used plating substances into reusable plating substances, and adding the reusable plating substances to the plating cell.

6. The method of claim 1, further comprising disposing of the used plating substances without reusing the used plating substances.

7. The method of claim 1, wherein the plating substances include copper and wherein the objects are plated with copper.

8. The method of claim 1, wherein each of the objects is a wafer configured to be a component of a semiconductor.

9. The method of claim 1, wherein said at least one monitored aspect is chosen from the number of objects plated in the plating cell, the time elapsed during the plating of the objects, current density applied during the plating, electrical energy applied during the plating, idle time elapsed when the plating does not occur, amount of agitation of substances in the plating cell, amount of pulse plating occurring during the plating, temperature of substances in the plating cell, temperature of the plating cell, the deposition rate of material plated on the objects, the electrical conductivity of material plated on the objects, concentration of carbon in material plated on the objects, the degree of void-free plating in trenches of the objects, and the chemical composition of the plating substances.

10. A method of plating objects, the method comprising:

adding plating substances to a plating cell;

placing objects in the plating cell;

plating the objects in the plating cell, wherein the amount of at least one component of the plating substances is reduced during the plating of the objects;

removing the plated objects from the plating cell;

draining used plating substances from the plating cell;

monitoring at least one aspect associated with the plating of the objects, the aspect being related to the reduction in amount of the at least one component of the plating substances during the plating; and adjusting, based on said at least one monitored aspect, at least one of the flow rate of the plating substances added to the plating cell from at least one rate greater than zero to another rate greater than zero, and the flow rate of the used plating substances drained from the plating cell from at least one rate greater than zero to another rate greater than zero, to substantially maintain a concentration of the at least one component in the plating cell above a predetermined level.

11. The method of claim 10, wherein the adjusting includes both adjusting the flow rate of the plating substances added to the plating cell and adjusting the flow rate of the used plating substances drained from the plating cell.

12. The method of claim 10, wherein the plating substances include organic substances and inorganic substances, and wherein said at least one component is at least part of at least one of the organic substances.

13. The method of claim 10, wherein both the adding of the plating substances and the draining of the used plating substances occur during substantially all of the plating of the objects.

14. The method of claim 10, further comprising processing the used plating substances to convert at least part of the used plating substances into reusable plating substances, and adding the reusable plating substances to the plating cell.

15. The method of claim 10, further comprising disposing of the used plating substances without reusing the used plating substances.

16. The method of claim 10, wherein the plating substances include copper and wherein the objects are plated with copper.

17. The method of claim 10, wherein each of the objects is a wafer.

18. The method of claim 10, wherein each of the objects is a wafer configured to be a component of a semiconductor.

19. The method of claim 10, wherein said at least one monitored aspect is chosen from the number of objects plated in the plating cell, the time elapsed during the plating of the objects, current density applied during the plating, electrical energy applied during the plating, idle time elapsed when the plating does not occur, amount of agitation of substances in the plating cell, amount of pulse plating occurring during the plating, temperature of substances in the plating cell, temperature of the plating cell, the deposition rate of material plated on the objects, the electrical conductivity of material plated on the objects, concentration of carbon in material plated on the objects, the degree of void-free plating in trenches of the objects, and the chemical composition of the plating substances.

20. A method of plating objects, the method comprising:

adding plating substances to a plating cell;

placing objects in the plating cell;

plating the objects in the plating cell, wherein at least one byproduct of at least one of the plating substances is created during the plating;

removing the plated objects from the plating cell;

draining used plating substances from the plating cell, the used plating substances including the at least one byproduct;

purifying the used plating substances to remove at least some of the at least one byproduct and thereby create purified plating substances;

combining at least one component with the purified plating substances to create a mixture of plating substances; and passing the mixture of plating substances into the plating cell to thereby reuse the purified plating substances wherein the plating substances include organic substances and inorganic substances, and wherein said at least one byproduct is created from at least one of the organic substances, and wherein the purifying includes removing substantially all plating substances containing organic material, and wherein the at least one component includes organic material.

21. The method of claim 20, wherein the at least one component includes organic material, and wherein the method further comprises monitoring the level of organic material in the mixture of plating substances.

22. The method of claim 21, wherein the method further comprises adjusting, based on the monitored level of organic material in the mixture, the amount of the at least one component combined with the purified plating substances.

23. The method of claim 20, wherein the purified plating substances include at least a substantial portion of the inorganic substances.

24. The method of claim 20, wherein the purifying includes at least one of filtering the used plating substances with activated carbon, filtering the used plating substances with at least one ion exchange medium compound, filtering the plating substances with a particle removal filter, exposing the used plating substances to ultraviolet light, heating the used plating substances, exposing the used plating substances to at least one chemical oxidizing substance, and degassing the used plating substances.

25. The method of claim 20, wherein the method further comprises:

monitoring at least one aspect associated with the plating of the objects, the aspect being related to the creation of the at least one byproduct; and adjusting, based on said at least one monitored aspect, at least one of the flow rate of the plating substances added to the plating cell, and the flow rate of the used plating substances drained from the plating cell, to substantially maintain a concentration of the at least one byproduct in the plating cell below a predetermined level.

26. The method of claim 20, wherein both the adding of the plating substances and the draining of the used plating substances occur during substantially all of the plating of the objects.

27. The method of claim 20, wherein the plating substances include copper and wherein the objects are plated with copper.

28. The method of claim 20, wherein each of the objects is a wafer.

29. The method of claim 20, wherein each of the objects is a wafer configured to be a component of a semiconductor.

30. The method of claim 20, wherein the purifying also includes removing HCl from the used plating substances and wherein the combining includes adding HCl to the purified plating substances.

31. The method of claim 20, further comprising adding fresh plating substances to the plating cell and removing at least predetermined types of free ions from the fresh plating substances.

32. The method of claim 20, wherein the used plating substances are purified in a purifier and wherein the following equation is satisfied:

$$C_{b,t2} = C_{b,t0} + \frac{(t2 - t1)}{V} \times (m_b - \eta_b \cdot dV_p \cdot C_{b,t1})$$

wherein t1=a time, t2=a time after t1, $C_{b,\ t2}$=byproduct concentration at time t2, $C_{b,\ t1}$=byproduct concentration at time t1, $C_{b,\ t0}$=initial plating solution byproduct concentration, V=volume of plating substances in at least one of the plating cell and a storage tank associated with the plating cell, $m_b$=mass rate of byproduct build up, $dV_p$=liquid flow rate through the purifier, and $\eta_b$=byproduct removal efficiency of the purifier.

33. The method of claim 20, wherein the used plating substances are purified in a purifier and wherein the following equation is satisfied:

$$C_{c,t2} = C_{c,t0} + \frac{(t2 - t1)}{V} \times \left( \frac{V_c \cdot q \cdot dt}{(t2 - t1)} - m_c - h_c \cdot dV_p \cdot C_{c,t1} \right)$$

wherein t1=a time, t2=a time after t1,

V=volume of plating substances in at least one of the plating cell and a storage tank associated with the plating cell, $C_{c,\ t2}$=component concentration at time t2, $C_{c,\ t1}$=component concentration at time t1, $C_{c,\ t0}$=initial plating solution component concentration, $V_c$=flow rate of component introduction, q=component density, dt=time interval of component introduction, $dV_p$=liquid flow rate through the purifier, $m_c$=mass rate of component consumption during the plating, and $h_c$=component removal efficiency of the purifier.

34. A method of plating objects, the method comprising:

adding plating substances to a plating cell;

placing objects in the plating cell;

plating the objects in the plating cell, wherein at least one byproduct of at least one of the plating substances is created during the plating;

removing the plated objects from the plating cell;

draining used plating substances from the plating cell, the used plating substances including the at least one byproduct;

purifying the used plating substances to remove at least some of the at least one byproduct and thereby create purified plating substances;

combining at least one component with the purified plating substances to create a mixture of plating substances; and passing the mixture of plating substances into the plating cell to thereby reuse the purified plating substances, wherein the plating substances include organic substances and inorganic substances, and wherein said at least one byproduct is created from at least one of the organic substances, wherein the at least one byproduct includes organic material, and wherein the method further comprises monitoring the level of organic material in the purified plating substances.

35. The method of claim 34, wherein the at least one component includes organic material, and wherein the method further comprises adjusting, based on the monitored level of organic material, the amount of the at least one component combined with the purified plating substances.

36. The method of claim 35, wherein the method further comprises monitoring the level of organic material in the mixture of plating substances, and adjusting, based on the monitored level of organic material in the mixture, the amount of the at least one component combined with the purified plating substances.

37. The method of claim 34, wherein the used plating substances are purified in a purifier and wherein the following equation is satisfied:

$$C_{b,t2} = C_{b,t0} + \frac{(t2 - t1)}{V} \times (m_b - \eta_b \cdot dV_p \cdot C_{b,t1})$$

wherein t1=a time, t2=a time after t1, $C_{b,\ t2}$=byproduct concentration at time t2, $C_{b,t1}$=byproduct concentration at time t1, $C_{b,\ t0}$=initial plating solution byproduct concentration, V=volume of plating substances in at least one of the plating cell and a storage tank associated with the plating cell, $m_b$=mass rate of byproduct build up, $dV_p$=liquid flow rate through the purifier, and $\eta_b$=byproduct removal efficiency of the purifier.

38. The method of claim 34, wherein the used plating substances are purified in a purifier and wherein the following equation is satisfied:

$$C_{c,t2} = C_{c,t0} + \frac{(t2 - t1)}{V} \times \left( \frac{V_c \cdot q \cdot dt}{(t2 - t1)} - m_c - h_c \cdot dV_p \cdot C_{c,t1} \right)$$

wherein t1=a time, t2=a time after t1,

V=volume of plating substances in at least one of the plating cell and a storage tank associated with the plating cell, $C_{c,\ t2}$=component concentration at time t2, $C_{c,\ t1}$=component concentration at time t1, $C_{c,\ t0}$=initial plating solution component concentration, $V_c$=flow rate of component introduction, q=component density, dt=time interval of component introduction, $dV_p$=liquid flow rate through the purifier, $m_c$=mass rate of component consumption during the plating, and $h_c$=component removal efficiency of the purifier.

39. A method of plating objects, the method comprising:

adding plating substances to a plating cell;

placing objects in the plating cell;

plating the objects in the plating cell, wherein at least one byproduct of at least one of the plating substances is created during the plating;

removing the plated objects from the plating cell;

draining used plating substances from the plating cell, the used plating substances including the at least one byproduct;

purifying the used plating substances to remove at least some of the at least one byproduct and thereby create purified plating substances;

combining at least one component with the purified plating substances to create a mixture of plating substances; and passing the mixture of plating substances into the plating cell to thereby reuse the purified plating substances, wherein the at least one component includes organic material, and wherein the method further comprises monitoring the level of organic material in the mixture of plating substances, wherein the method further comprises passing the mixture of plating substances into a storage tank in flow communication with the plating cell, and wherein the mixture in the storage tank is monitored to determine the level of organic material.

40. The method of claim 39, wherein multiple plating cells are provided and a separate storage tank is associated with each of the plating cells, and wherein the method further comprises monitoring organic material in each storage tank substantially simultaneously.

41. The method of claim 40, wherein the organic material in each storage tank is monitored via a separate sensing probe in each storage tank and a common controller receiving a respective signal from each sensing probe.

42. A method of plating objects, the method comprising:

adding plating substances to a plating cell;

placing objects in the plating cell;

plating the objects in the plating cell, wherein at least one byproduct of at least one of the plating substances is created during the plating;

removing the plated objects from the plating cell;

draining used plating substances from the plating cell, the used plating substances including the at least one byproduct; and purifying the used plating substances in a purifier to remove at least some of the at least one byproduct and thereby create purified plating substances, wherein the following equation is satisfied:

$$C_{b,t2} = C_{b,t0} + \frac{(t2 - t1)}{V} \times (m_b - \eta_b \cdot dV_p \cdot C_{b,t1})$$

wherein t1=a time, t2=a time after t1, $C_{b,\ t2}$=byproduct concentration at time t2, $C_{b,\ t1}$=byproduct concentration at time t1, $C_{b,\ t0}$=initial plating solution byproduct concentration, V=volume of plating substances in at least one of the plating cell and a storage tank associated with the plating cell, $m_b$=mass rate of byproduct build up, $dV_p$=liquid flow rate through the purifier, and $\eta_b$=byproduct removal efficiency of the purifier.

43. A method of plating objects, the method comprising:

adding plating substances to a plating cell;

placing objects in the plating cell;

plating the objects in the plating cell, wherein at least one byproduct of at least one of the plating substances is created during the plating;

removing the plated objects from the plating cell;

draining used plating substances from the plating cell, the used plating substances including the at least one byproduct; and purifying the used plating substances in a purifier to remove at least some of the at least one byproduct and thereby create purified plating substances;

combining at least one component with the purified plating substances to create a mixture of plating substances; and passing the mixture of plating substances into the plating cell, wherein the following equation is satisfied:

$$C_{c,t2} = C_{c,t0} + \frac{(t2-t1)}{V} \times \left( \frac{V_c \cdot q \cdot dt}{(t2-t1)} - m_c - h_c \cdot dV_p \cdot C_{c,t1} \right)$$

wherein t1=a time, t2=a time after t1,

V=volume of plating substances in at least one of the plating cell and a storage tank associated with the plating cell, $C_{c,\ t2}$=component concentration at time t2, $C_{c,\ t1}$=component concentration at time t1, $C_{c,\ t0}$=initial plating solution component concentration, $V_c$=flow rate of component introduction, q=component density, dt=time interval of component introduction, $dV_p$=liquid flow rate through the purifier, $m_c$=mass rate of component consumption during the plating, and $h_c$=component removal efficiency of the purifier.

44. A method of plating objects, the method comprising:

adding plating substances to a plating cell;

placing objects in the plating cell;

plating the objects in the plating cell, wherein at least one byproduct of at least one of the plating substances is created during the plating;

removing the plated objects from the plating cell;

draining used plating substances from the plating cell, the used plating substances including the at least one byproduct;

purifying the used plating substances in a purifier to remove at least some of the at least one byproduct and thereby create purified plating substances;

combining at least one component with the purified plating substances to create a mixture of plating substances; and passing the mixture of plating substances into the plating cell to thereby reuse the purified plating substances, wherein the following equation is satisfied:

$$C_{b,t2} = C_{b,t0} + \frac{(t2-t1)}{V} \times (m_b - \eta_b \cdot dV_p \cdot C_{b,t1})$$

wherein t1=a time, t2=a time after t1, $C_{b,\ t2}$=byproduct concentration at time t2, $C_{b,\ t1}$=byproduct concentration at time t1, $C_{b,\ t0}$=initial plating solution byproduct concentration, V=volume of plating substances in at least one of the plating cell and a storage tank associated with the plating cell, $m_b$=mass rate of byproduct build up, $dV_p$=liquid flow rate through the purifier, and $\eta_b$=byproduct removal efficiency of the purifier.

45. A method of plating objects, the method comprising:

adding plating substances to a plating cell;

placing objects in the plating cell;

plating the objects in the plating cell, wherein at least one byproduct of at least one of the plating substances is created during the plating;

removing the plated objects from the plating cell;

draining used plating substances from the plating cell, the used plating substances including the at least one byproduct;

purifying the used plating substances in a purifier to remove at least some of the at least one byproduct and thereby create purified plating substances;

combining at least one component with the purified plating substances to create a mixture of plating substances; and passing the mixture of plating substances into the plating cell to thereby reuse the purified plating substances, wherein the following equation is satisfied:

$$C_{c,t2} = C_{c,t0} + \frac{(t2-t1)}{V} \times \left( \frac{V_c \cdot q \cdot dt}{(t2-t1)} - m_c - h_c \cdot dV_p \cdot C_{c,t1} \right)$$

wherein t1=a time, t2=a time after t1,

V=volume of plating substances in at least one of the plating cell and a storage tank associated with the plating cell, $C_{c,t2}$=component concentration at time t2, $C_{c,\ t1}$=component concentration at time t1, $C_{c,\ t0}$=to initial plating solution component concentration, $V_c$=flow rate of component introduction, q=component density, dt=time interval of component introduction, $dV_p$=liquid flow rate through the purifier, $m_c$=mass rate of component consumption during the plating, and $h_c$=component removal efficiency of the purifier.

* * * * *

UNITED STATES PATENT AND TRADEMARK OFFICE

CERTIFICATE OF CORRECTION

PATENT NO. : 6,569,307 B2 
DATED : May 27, 2003
INVENTOR(S) : Olivier J. Blachier et al.

It is certified that error appears in the above-identified patent and that said Letters Patent is hereby corrected as shown below:

Column 17,
Line 9, please replace "$C_{b,\ ttl}$" with -- $C_{b,\ tl}$ --.

Column 20,
Line 41, please replace "$C_{c,\ t0}$" with -- $C_{c,\ t0}$ --.

Signed and Sealed this

Ninth Day of September, 2003

JAMES E. ROGAN
*Director of the United States Patent and Trademark Office*